US012465077B2

(12) United States Patent
Jeoung

(10) Patent No.: US 12,465,077 B2
(45) Date of Patent: Nov. 11, 2025

(54) COMBUSTIBLE HEAT SOURCE COMPOSITION FOR SMOKING ARTICLE AND SMOKING ARTICLE COMPRISING SAME

(71) Applicant: KT&G CORPORATION, Daejeon (KR)

(72) Inventor: Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 18/034,928

(22) PCT Filed: Nov. 29, 2022

(86) PCT No.: PCT/KR2022/019080
§ 371 (c)(1),
(2) Date: May 2, 2023

(87) PCT Pub. No.: WO2023/121030
PCT Pub. Date: Jun. 29, 2023

(65) Prior Publication Data

US 2024/0334968 A1 Oct. 10, 2024

(30) Foreign Application Priority Data

Dec. 23, 2021 (KR) ..... 10-2021-0186251

(51) Int. Cl.
*A24D 1/22* (2020.01)
*A24B 15/16* (2020.01)
*A24B 15/30* (2006.01)

(52) U.S. Cl.
CPC ..... *A24D 1/22* (2020.01); *A24B 15/165* (2013.01); *A24B 15/30* (2013.01)

(58) Field of Classification Search
None
See application file for complete search history.

(56) References Cited

U.S. PATENT DOCUMENTS 3,934,594 A 1/1976 Beringer et al.
9,999,246 B2 * 6/2018 Suzuki ..... A24B 15/165
(Continued)

FOREIGN PATENT DOCUMENTS

EP 4 233 568 A1 8/2023
JP H07-145395 A 6/1995
(Continued)

OTHER PUBLICATIONS

Extended European Search Report dated Mar. 19, 2024 in Application No. 22893950.0.
(Continued)

*Primary Examiner* — Dennis R Cordray
(74) *Attorney, Agent, or Firm* — Sughrue Mion, PLLC

(57) ABSTRACT

The present disclosure relates to a combustible heat source composition, and more particularly, to a combustible heat source composition comprising a carbon powder, an organic binder, and an ignition accelerator, wherein the ignition accelerator comprises potassium nitrate and a reducing sugar, and the potassium nitrate and the reducing sugar are contained at a weight ratio of 5 to 3:2. A smoking article to which a combustible heat source composed of the composition is applied is characterized by having excellent ignitability and combustibility.

7 Claims, 1 Drawing Sheet

| # | Comparative Embodiment 8 | Embodiment 1 | Comparative Embodiment 6 |
|---|---|---|---|
| Combustion image |  |  |  |
| Combustion phenomenon | Ignition takes 40s/Flame generation/Brokenness Combustion is stopped due to broken combustion body | Ignition takes 25s/Non-generation of flame/Good shape-maintaining combustion | Ignition delay/Combustion is not sustained |

(56) References Cited

U.S. PATENT DOCUMENTS

| | | | | |
|---|---|---|---|---|
| 2014/0283860 | A1* | 9/2014 | Stolz | A24B 15/165 131/330 |
| 2018/0014571 | A1* | 1/2018 | Nakano | A61M 11/047 |

FOREIGN PATENT DOCUMENTS

| | | | |
|---|---|---|---|
| JP | 2003-116512 | A | 4/2003 |
| JP | 2012-504972 | A | 3/2012 |
| KR | 10-2008-0098433 | A | 11/2008 |
| KR | 10-2017-0037680 | A | 4/2017 |
| KR | 10-2019-0086580 | A | 7/2019 |
| KR | 10-2047720 | B1 | 11/2019 |
| KR | 10-2020-0030364 | A | 3/2020 |
| WO | 2015/022317 | A1 | 2/2015 |
| WO | 2021/122451 | A1 | 6/2021 |

OTHER PUBLICATIONS

International Search Report for PCT/KR2022/019080 dated Mar. 6, 2023.

* cited by examiner

| # | Comparative Embodiment 8 | Embodiment 1 | Comparative Embodiment 6 |
|---|---|---|---|
| Combustion image | 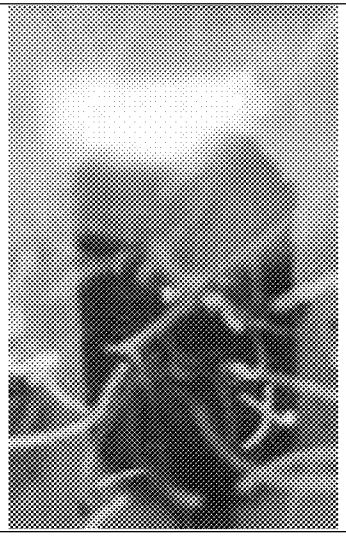 | 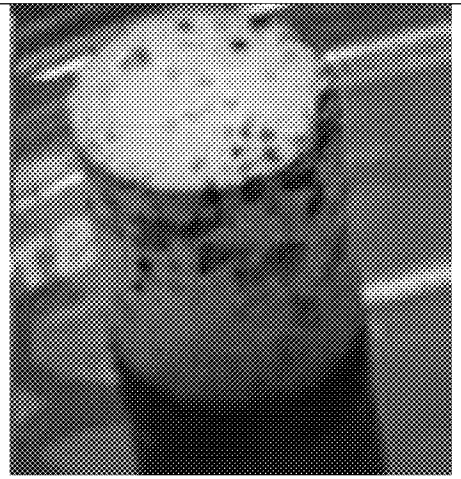 | 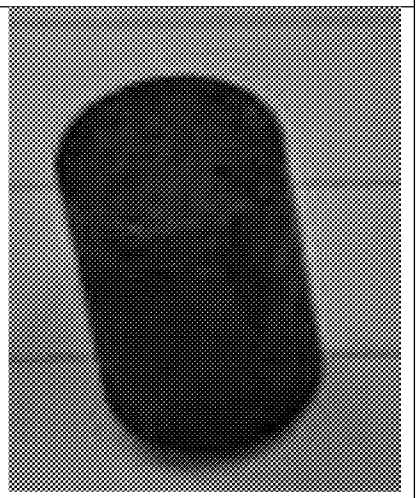 |
| Combustion phenomenon | Ignition takes 40s/Flame generation/Brokenness Combustion is stopped due to broken combustion body | Ignition takes 25s/Non-generation of flame/Good shape-maintaining combustion | Ignition delay/Combustion is not sustained |

COMBUSTIBLE HEAT SOURCE COMPOSITION FOR SMOKING ARTICLE AND SMOKING ARTICLE COMPRISING SAME

CROSS REFERENCE TO RELATED APPLICATIONS

This application is a National Stage of International Application No. PCT/KR2022/019080 filed Nov. 29, 2022, claiming priority based on Korean Patent Application No. 10-2021-0186251 filed Dec. 23, 2021.

TECHNICAL FIELD

The following description relates to a combustible heat source composition for a smoking article, and a smoking article comprising the same.

BACKGROUND ART

A number of smoking articles which are heated rather than combusted have recently been proposed. Unlike conventional smoking articles, these non-combustion type smoking articles are used by sucking an aerosol generated by heating the smoking article medium without burning the smoking article medium. As one of these types of heating-type smoking articles, there is a smoking article product to which a carbon heat source is applied.

A smoking article to which the carbon heat source is applied generates an aerosol by heat transfer from the carbon heat source to a smoking article medium located downstream of the carbon heat source.

The smoking article product to which the carbon heat source is applied has a smoking form similar to that of a traditional smoking article, unlike general heating-type electronic smoking articles using a dedicated device, so that consumers' smoking convenience and satisfaction can be expected to be improved.

RELATED ART DOCUMENT

Patent Document (Patent Document 1) Korean Patent Publication No. 2020-0030364

DISCLOSURE OF THE INVENTION

Technical Goals

An object of the present disclosure is to provide a combustible heat source composition having excellent ignitability and combustion persistency, and a smoking article comprising the heat source composition.

Technical Solutions

The present disclosure provides a combustible heat source composition comprising a carbon powder, an organic binder, and an ignition accelerator, wherein the ignition accelerator comprises potassium nitrate and reducing sugar, and the potassium nitrate and reducing sugar are contained at a weight ratio of 5 to 3:2.

As one embodiment of the present disclosure, the ignition accelerator may be contained in an amount of 10 to 20% by weight.

As another embodiment of the present disclosure, the reducing sugar may include one or more sugar alcohols selected from the group consisting of sorbitol, xylitol, mannitol, maltitol, lactitol, erythritol, reduced palatinose, and reduced starch syrup.

As yet another embodiment of the present disclosure, the carbon powder comprises charcoal and graphite, and may be contained in an amount of 50% by weight or more.

As still another embodiment of the present disclosure, the organic binder may be one or more selected from the group consisting of carboxymethylcellulose (CMC), guar gum, methylcellulose (MC), and hydroxypropyl methylcellulose (HPMC).

As yet still another embodiment of the present disclosure, the heat source may be ignited within 30 seconds, and combustion may continue for 140 seconds or more.

Furthermore, the present disclosure provides a smoking article comprising a combustible heat source composed of the composition.

Effects

Conventional combustible heat sources have had limitations in that ignition is not easy due to charcoal as the main component. Accordingly, the present disclosure uses potassium nitrate and reducing sugar to facilitate the ignition of the combustible heat source, and the heat source consisting of the composition according to the present disclosure is characterized by having improved ignitability and combustibility compared to the conventional heat sources.

BRIEF DESCRIPTION OF DRAWINGS

FIG. 1 is a view showing combustion results of combustible heat sources manufactured in Embodiments of the present disclosure.

BEST MODE FOR CARRYING OUT THE INVENTION

Hereinafter, the present disclosure will be described in detail so that those skilled in the art to which the present disclosure pertains can easily carry out the present disclosure. However, the present disclosure may be embodied in many different forms and is not limited to the content described herein.

Throughout the specification, "lengthwise direction of a smoking article comprising a combustible heat source" means a direction in which the length of the smoking article comprising a combustible heat source extends or a direction in which combustion proceeds when the smoking article comprising a combustible heat source is combusted.

Throughout the specification, in the terms "upstream" and "downstream", a part where air enters from the outside to the inside of the smoking article comprising a combustible heat source when the user sucks in outside air using a smoking article comprising a combustible heat source is an "upstream", and a portion where air exits from the inside to the outside of the smoking article comprising a combustible heat source is a "downstream". The terms "upstream" and "downstream" may be used to indicate the relative position or direction between parts that make up the smoking article comprising the combustible heat source.

Demand for heating-type electronic smoking articles is increasing. Most heating-type electronic smoking articles have a device in the structure of [device+dedicated stick]. As a new type of smoking article, a product having a smoking form similar to those of general smoking articles is being developed by applying a carbon-based heat source to the tip of the smoking article. Accordingly, the present disclosure has attempted to develop a combustible heat source that can have a smoking form (ignition, smoking start point) similar to those of the general smoking articles.

Since existing combustible heat sources mainly comprise charcoal, there has been a limitation in that the existing combustible heat sources are not easy to ignite.

Accordingly, the present disclosure is intended to present a combustible heat source composition having improved ignitability and a smoking article to which a combustible heat source comprising the combustible heat source composition is applied.

Accordingly, the present disclosure provides a combustible heat source composition comprising a carbon powder, an organic binder, and an ignition accelerator, wherein the ignition accelerator comprises potassium nitrate and reducing sugar, and the potassium nitrate and reducing sugar are contained at a weight ratio of 5 to 3:2.

Furthermore, the present disclosure may provide a smoking article comprising a combustible heat source composed of the composition.

Hereinafter, the present disclosure will be described in more detail.

Combustion of the combustible heat source according to the present disclosure is proceeded by the moisture removal reaction, the pyrolysis reaction of the reducing sugar, the reaction of potassium nitrate and reducing sugar, and the combustion reaction of the carbon powder (charcoal).

First, when ignition starts in the combustible heat source, a moisture removal reaction occurs between 0 and 150° C. as the first step. In practice, when the air-dry progresses at existing room temperature, the evaporation process of the inherent moisture generated at 100° C. or more is generated after the surface moisture removed so that some of internal pores are generated, and the surface area constantly rises accordingly.

As the second step, the pyrolysis reaction of the reducing sugar in which the ignition progresses is progressed, and the pyrolysis reaction itself of the reducing sugar occurs near 200° C. to 360° C. While a portion of reducing sugar is being melted during this process, it is subjected to the oxidation reaction so that some heat is generated.

In the third combustion stage, nitrate and reducing sugar explosively react within a short time near 360° C. to 400° C. In practice, since not only the combustion time responds to a relatively shorter time than other reactions, but also a large amount of calories is generated, actual ignition starts. That is, in the present disclosure, the ignitability of the heat source is adjusted by checking the suitable mixing amount of the nitrate and reducing sugar.

In the fourth combustion stage, the combustion reaction of charcoal may progress gradually at 400° C. to 600° C. after the ignition of the heat source in the third step.

That is, the combustible heat source composition according to the present disclosure is characterized by comprising the potassium nitrate and reducing sugar as the ignition accelerator. The potassium nitrate and reducing sugar are contained by being mixed at a weight ratio of 5 to 3:2, and excellent ignition efficiency can be achieved at the weight ratio. It is preferable that potassium nitrate is contained in the ignition accelerator in an amount larger than reducing sugar.

The ignition accelerator is contained in an amount of 10 to 20% by weight, wherein if the ignition accelerator is contained in an amount of less than 10% by weight, the ignition may not progress smoothly, and if it is contained in an amount of exceeding 20% by weight, the ignitability may increase, but the combustion of the heat source may be excessively promoted to reduce the time capable of smoking. In the ignition accelerator, potassium nitrate may be contained in an amount of 5 to 12% by weight, and reducing sugar may be contained in an amount of 1 to 9% by weight. When the potassium nitrate and reducing sugar are most preferably mixed at a weight ratio of 3:2 and used, the optimal ignition efficiency may be obtained.

The reducing sugar in the composition according to the present disclosure is sugar alcohol, which may be sorbitol, xylitol, mannitol, maltitol, lactitol, erythritol, reduced palatinose, or reduced starch syrup. If the reducing sugar is sugar alcohol, it is not limited to the above types, but mannitol may be preferable for use as a fuel concept due to its low hygroscopicity, and sorbitol capable of reducing ejecta that may be generated by application of potassium nitrate/reducing sugar may be used.

The carbon powder of the composition according to the present disclosure comprises charcoal and graphite.

The charcoal is used as a fuel that is ignited as a main material of a heat source and maintains combustion. The charcoal is preferably contained in an amount of 40% by weight or more based on 100% by weight of the solid content, and may maintain a temperature necessary for smoking for 3 minutes or more by being contained in an amount of 40% by weight or more.

The graphite increases the density of the heat source and may help to maintain combustion. The graphite may be contained in an amount of 1 to 10% by weight, and if it is contained in an amount of less than 1% by weight, the combustion persistency may be reduced due to insufficient density of the heat source, and if it is contained in an amount of more than 10% by weight, the density may become high and thus affect ignitability.

In the present disclosure, carboxymethylcellulose (CMC), guar gum, methylcellulose (MC), or hydroxypropyl methylcellulose (HPMC) may be used as the organic binder, but if the organic binder is a material capable of binding carbon powder, it may be included without being limited to the above types.

After mixing, the heat source composition according to the present disclosure may be compressed into a molded body. In the present disclosure, a polyhydric alcohol may be added to the composition for use. The polyhydric alcohol assists combustion and may be glycerin or propylene glycol. The polyhydric alcohol may be used in an amount of 1 to 5 parts by weight based on 100 parts by weight of the heat source composition.

The heat source may be ignited within 30 seconds, and combustion may last for 140 seconds or longer. The heat source having the ignition time and the combustion time may have a diameter of 5 to 10 mm and a length of 8 to 15 nm, but is not limited thereto.

According to one embodiment of the present disclosure, the combustible heat source is formed by mixing the composition and forming the mixture in advance into a desired shape. It may be pre-formed into a desired shape using any suitable known ceramic forming methods, for example, slip casting, extrusion molding, injection molding, mold compression, or pressurization.

Preferably, the combustible heat source is formed by a pressurization process or an extrusion process. Most preferably, the combustible heat source is formed by a pressurization process.

Preferably, the combustible heat source may have an apparent density between about 0.8 g/cm$^3$ and about 3.0 g/cm$^3$, preferably, the combustible heat source may have a mass between about 300 mg and about 500 mg, more preferably about 400 mg and about 450 mg.

The combustible heat source may be a circular cross-sectional cylindrical or tapered cylindrical form or a substantially elliptical cross-sectional cylindrical or tapered cylindrical form, but is not limited thereto.

Further, the present disclosure may provide a smoking article to which the heat source is applied.

The "smoking article" may mean any smokeable product or any product that can provide a smoking experience regardless of whether or not it is based on tobacco, tobacco derivatives, expanded tobacco, reconstituted tobacco, or tobacco substitutes. For example, the smoking article may mean a smokeable article capable of generating an aerosol, such as a cigarette, cigar, cigarillo, or the like.

The smoking article may comprise a combustible heat source composed of the composition, a medium part, a thermally conductive wrapper, cigarette paper, a cooling part, a filter part, etc., and the combustible heat source; the medium part; the cooling part; and the filter part may be aligned in order based on the longitudinal direction, but the order can be freely changed except for the case where the combustible heat source is located upstream. In addition to this, additional configurations may be further included or one or more of the above-described configurations may be omitted. The smoking article may have a diameter of, for example, 4 mm to 10 mm, and a circumference of 14 mm to 29 mm. In addition, the smoking article may have a length of 45 mm to 100 mm.

The medium part may include, for example, at least one of cut tobacco, cut reconstituted tobacco leaves, smoking article leaves, expanded smoking article, and nicotine extract. The medium part may contain a nicotine component. In addition to the medium part, an aerosol-generating material may be further contained. The aerosol-generating material may include polyhydric alcohols, esters of polyhydric alcohols such as glycerol mono-, di- or triacetate, and aliphatic esters of mono-, di- or esters of polycarboxylic acids such as dimethyl dodecanedioate and dimethyl tetradecanedioate. More specifically, the aerosol-generating material may include, for example, at least one of glycerin, propylene glycol, ethylene glycol, dipropylene glycol, diethylene glycol, triethylene glycol, tetraethylene glycol, and oleyl alcohol. For example, the medium part may include cut reconstituted tobacco leaves immersed in glycerin. However, this is an example and the present disclosure is not necessarily limited to the description described above.

The medium part may have a length between about 5 mm and about 20 mm, more preferably between about 8 mm and about 12 mm. The medium part is surrounded by paper or other wrapper and may be in the form of a plug or part containing a material capable of releasing volatile compounds in response to heating. As described above, when the medium part is in the form of a plug or part, the entire plug or part including any wrapper is considered to be the medium part.

The cooling part may contain a cooling material. The cooling part includes a tubular hollow body with an open end, and may cool airflow passing through the heat source and the medium part. The cooling part may be made of a polymer material or a biodegradable polymer material and may have a cooling function. For example, the cooling part may be paper, cardboard, plastic, and may be, for example, cellulose acetate, ceramic, and a combination thereof. Additionally, the cooling part may include a corrugated sheet of material selected from the group consisting of metal foil, polymeric material, and substantially non-porous paper or cardboard. In certain embodiments, the aerosol cooling element may also include a corrugated sheet of material selected from the group consisting of polyethylene (PE), polypropylene (PP), polyvinyl chloride (PVC), polyethylene terephthalate (PET), polylactic acid (PLA), cellulose acetate (CA), and aluminum foil. The cooling part may have a length between about 5 mm and about 30 mm, more preferably between about 8 mm and about 25 mm, but the length may be freely adjusted in consideration of the temperature of heat generated from a heatable heat source.

The filter part contains a filter material, and the shape of the filter part is not limited. For example, the filter part may be a cylinder-type rod or a tube-type rod including a hollow therein. Alternatively, the filter part may be a recess-type rod. If the filter part is composed of a plurality of segments, at least one of the plurality of segments may be manufactured in a different shape. For example, the filter part may include a fibrous phase, a filament phase, or a filter tow including both thereof, containing at least one of polymer, paper, cellulose acetate, activated carbon, and carbon, but is not limited thereto. The filter part, for example, may have a length of 5 to 20 mm.

In addition to this, the filter may further comprise a tipping paper in contact with the mouth, which surrounds the filter material. The tipping paper may have one or more perforations formed therein.

The filter part may be manufactured to generate flavor. As an example, a flavoring liquid may be sprayed onto the filter material, and a separate fiber coated with the flavoring liquid may be inserted into the filter part.

The cooling part and the filter part may contain an aerosol modifier. For example, one or more of the cooling part, filter part, and tipping paper of the smoking article according to the present disclosure may contain one or more aerosol modifiers. Suitable aerosol modifiers may not be limited thereto, but may include a flavoring agent and a chemesthetic agent. The flavoring agent is used to describe any substance that, when used, imparts taste, aroma, or both thereof to aerosols generated by a tobacco material and an aerosol-generating material of the smoking article.

In addition, the cigarette paper is composed of cellulose fibers obtained from wood, flax, or other materials, and may be wrapped around a medium part, wrapped around the entire smoking article comprising the medium part, or wrapped around a part except for the filter part. The base paper of the cigarette paper may have a thickness of about 30 μm to about 100 μm, and the base paper may have a basis weight of about 15 g/m$^2$ to about 80 g/m$^2$.

The smoking article according to the present disclosure may also comprise downstream one or more aerosol modifiers that are both a flavoring agent and a chemesthetic agent. For example, one or more of the cooling part and filter part of the smoking article according to the present disclosure may contain menthol or another flavoring agent that provides a cooling object sensory effect.

In addition, the smoking article comprising the combustible heat source may comprise a thermally conductive wrapper surrounding the combustible heat source and the medium part. The thermally conductive wrapper may completely surround the heat source and the medium part, partially surround a portion of the heat source and the medium part, or entirely surround a portion of the heat source and the medium part. The thermally conductive wrapper transfers heat generated from a combustible heat source to the tobacco material, and the wrapper may include metal foil wrappers such as an aluminum foil wrapper, a steel wrapper, an iron foil wrapper, and a copper foil wrapper; and metal alloy foil wrappers, and is not limited to the material as long as it is a material capable of efficiently transferring heat.

A metal barrier may be formed between the heatable heat source and the medium part. Here, the metal barrier may prevent direct contact of a combustible heat source part with the medium part, and may prevent some out of components generated in the combustible heat source part from moving to the medium part.

The thickness of the barrier may be appropriately adjusted to obtain good smoking performance. In a specific embodiment, the barrier may have a thickness between about 10 microns and about 500 microns. The barrier may include one or more metallic materials that are substantially thermally stable and non-combustible at the temperatures obtained by the combustible heat source upon ignition and combustion. Suitable materials are known in the art and are not limited thereto, but they include aluminum, copper, stainless steel, and combinations thereof.

Hereinafter, Embodiments will be described in detail with reference to the accompanying drawings. However, since various changes can be made to the Embodiments, the scope of rights of the patent application is not restricted or limited by these Embodiments. It should be understood that all changes, equivalents or substitutes to the Embodiments are included within the scope of rights.

Terms used in the Embodiments are used only for descriptive purposes and should not be construed as an intention of limiting the present disclosure. Singular expressions include plural expressions unless the context clearly dictates otherwise. In this specification, terms such as "include" or "have" are intended to designate that there is a feature, number, step, operation, component, part, or combination thereof described in the specification, but it should be understood that the presence or addition of one or more other features, numbers, steps, operations, components, parts, or combinations thereof is not precluded.

Unless defined otherwise, all terms used herein, including technical or scientific terms, have the same meaning as commonly understood by a person of ordinary skill in the art to which the Embodiments belong. Terms such as those defined in commonly used dictionaries should be interpreted as having a meaning consistent with the meaning in the context of the related art, and unless explicitly defined in the present application, they should not be interpreted in an ideal or excessively formal meaning.

In addition, in the description with reference to the accompanying drawings, the same reference numerals are given to the same components regardless of reference numerals, and overlapping descriptions thereof will be omitted. In describing Embodiments, if it is determined that a detailed description of a related known technology may unnecessarily obscure the gist of the Embodiments, the detailed description will be omitted.

EMBODIMENTS

1. Manufacture of Combustible Heat Sources

According to the compositions shown in Table 1 below, combustible heat source compositions comprising charcoal, potassium nitrate, binder, and reducing sugar were prepared. The heat sources were manufactured in the form of a cylinder with a diameter of 7 mm and a height of about 11 mm. Materials for manufacturing heat sources were prepared according to the mixing ratios and then mixed using an atmospheric pressure mixer (ARE-310 from THINKY). When mixing, each material was mixed at 1,500 RPM for 1 minute each time it was added.

An appropriate amount (2% by weight) of oil was added to the mixed powders and mixed at 1,500 RPM for 5 minutes. The mixed samples were divided into about 0.6 g and pressed through a press to form pressed samples in a cylinder shape.

The pressed samples were dried at 80° C. for 30 minutes through TGA (TGA791 from LECO).

TABLE 1

| | Solid mixing ratio (%, weight basis) | | | | |
|---|---|---|---|---|---|
| | Charcoal | Binder | $KNO_3$ | Reducing sugar | Sum |
| Embodiment 1 | Balance | 5 | 7.5 | 5 | 100 |
| Embodiment 2 | Balance | 5 | 11.25 | 7.5 | 100 |
| Embodiment 3 | Balance | 5 | 10 | 5 | 100 |
| Embodiment 4 | Balance | 5 | 12.5 | 5 | 100 |
| Embodiment 5 | Balance | 5 | 6 | 4 | 100 |
| Embodiment 6 | Balance | 5 | 12 | 8 | 100 |
| Comparative Embodiment 1 | Balance | 5 | 5 | 7.5 | 100 |
| Comparative Embodiment 2 | Balance | 5 | 5 | 10 | 100 |
| Comparative Embodiment 3 | Balance | 5 | 7.5 | 11.25 | 100 |
| Comparative Embodiment 4 | Balance | 5 | 5 | 2 | 100 |
| Comparative Embodiment 5 | Balance | 5 | 4 | 2 | 100 |
| Comparative Embodiment 6 | Balance | 5 | 3 | 2 | 100 |
| Comparative Embodiment 7 | Balance | 5 | 13.5 | 9 | 100 |
| Comparative Embodiment 8 | Balance | 5 | 15 | 10 | 100 |

2. Confirmation of Combustion Results of Combustible Heat Sources

The manufactured heat sources were ignited and then burned to show the observation results in Table 2 below.

TABLE 2

| | Ignitability | Combustion maintenance/surface combustion speed | Molding/drying unusual matters | Shape maintenance after combustion |
|---|---|---|---|---|
| Embodiment 1 | ○ Combustion started in 25 s | Surface combustion (takes 180 s) | No unusual matters | ○ |
| Embodiment 2 | ○ Combustion started in 22 s | Surface combustion (takes 165 s) | No unusual matters | ○ (Occurrence of slight brokenness) |
| Embodiment 3 | ○ Combustion | Surface combustion | No unusual matters | ○ |

TABLE 2-continued

| | Ignitability | Combustion maintenance/surface combustion speed | Molding/drying unusual matters | Shape maintenance after combustion |
|---|---|---|---|---|
| | started in 26 s | (takes 134 s, smoke generation) | | |
| Embodiment 4 | ○ Combustion started in 28 s | Surface combustion (takes 177 s) | No unusual matters | ○ (Occurrence of slight brokenness) |
| Embodiment 5 | ○ Combustion started in 40 s | Surface combustion (takes 211 s) | No unusual matters | ○ |
| Embodiment 6 | ○ Combustion started in 21 s | Surface combustion (takes 163 s) | No unusual matters | ○ |
| Comparative Embodiment 1 | ○ Combustion started in 26 s | Δ Flame generation | Being stuck to the mold | Δ (Partially broken) |
| Comparative Embodiment 2 | ○ Combustion started in 25 s | Δ Flame generation/Large amount of smoke generation | Being stuck to the mold | Δ (Partially broken) |
| Comparative Embodiment 3 | ○ Combustion started in 24 s | Δ Flame generation/Large amount of smoke generation | Being stuck to the mold | Δ (Partially broken) |
| Comparative Embodiment 4 | Δ Combustion started in 62 s | Δ Large amount of smoke generation | No unusual matters | X |
| Comparative Embodiment 5 | X Ignition failure | X Combustion does not last | No unusual matters | — |
| Comparative Embodiment 6 | X Ignition delay | X Combustion does not last | No unusual matters | — |
| Comparative Embodiment 7 | Δ Combustion started in 42 s | Δ Flame generation/Large amount of smoke generation, Combustion is stopped due to brokenness of combustion body | No unusual matters | X |
| Comparative Embodiment 8 | Δ Combustion started in 40 s | Δ Flame generation/Large amount of smoke generation, Combustion is stopped due to brokenness of combustion body | No unusual matters | X |

As can be confirmed from the results of Table 2, in the case of having the compositions as in Embodiments 1 to 6, good ignitability and combustibility were confirmed. In particular, good surface combustion was confirmed in Embodiments 1, 2, 5, and 6 containing potassium nitrate and reducing sugar at a weight ratio of 3:2.

Compared to this, in the case of Comparative Embodiments 1 to 3 containing relatively more reducing sugar, the surfaces of the heat sources were sticky and stuck to the mold, and a phenomenon that the heat sources are partially broken after combustion occurred. In addition, in the case of Comparative Embodiments 4 to 6 containing potassium nitrate and reducing sugar in an amount of less than 10% by weight, it was confirmed that ignition was not achieved or a large amount of smoke was generated due to reduced ignitability.

In addition, in the case of Comparative Embodiments 7 and 8 containing potassium nitrate and reducing sugar in an amount of exceeding 20% by weight, flame was generated, and combustion was stopped since the combustion body was broken.

Combustion images of Embodiment 1, Comparative Embodiment 6, and Comparative Embodiment 8 are shown in FIG. 1. As shown in FIG. 1, it can be seen that Embodiment 1 containing potassium nitrate and reducing sugar at a weight ratio of 3:2 also maintains a stable shape after the combustion together with excellent ignitability.

Although the above-mentioned embodiments have been described by limited drawings, those skilled in the art may apply various technical modifications and alterations based on the above-mentioned description. For example, appropriate results can be achieved although described techniques are carried out in a different order from a described method, and/or described elements of a system, structure, apparatus, circuit, etc. are combined or mixed in a different form from the described method, or replaced or substituted with other elements or equivalents.

Therefore, other embodiments, other examples, and equivalents to patent claims belong to the scope of the patent claims to be described later.

The invention claimed is:

1. A combustible heat source composition comprising a carbon powder, an organic binder, and an ignition accelerator, wherein the ignition accelerator comprises potassium nitrate and reducing sugar, and the potassium nitrate and reducing sugar are contained at a weight ratio of 5 to 3:2.

2. The combustible heat source composition of claim 1, wherein the ignition accelerator is contained in an amount of 10 to 20% by weight.

3. The combustible heat source composition of claim 1, wherein the reducing sugar is one or more sugar alcohols selected from the group consisting of sorbitol, xylitol, mannitol, maltitol, lactitol, erythritol, reduced palatinose, and reduced starch syrup.

4. The combustible heat source composition of claim 1, wherein the carbon powder comprises charcoal and graphite, and is contained in an amount of 40% by weight or more.

5. The combustible heat source composition of claim 4, wherein the organic binder is one or more selected from the group consisting of carboxymethylcellulose (CMC), guar gum, methylcellulose (MC), and hydroxypropyl methylcellulose (HPMC).

6. The combustible heat source composition of claim 1, wherein the heat source is ignited within 30 seconds, and combustion continues for 140 seconds or more.

7. A smoking article comprising a combustible heat source composed of the composition of claim 1.

* * * * *